US008002210B2

(12) United States Patent
Schmidt et al.

(10) Patent No.: US 8,002,210 B2
(45) **Date of Patent: *Aug. 23, 2011**

(54) APPARATUS FOR CANCELING SHEET MATERIAL

(75) Inventors: Alfred Schmidt, Munich (DE); Friedman Loeffler, Munich (DE); Wilhelm Hell, Mering (DE); Gerhard Sporer, Aschering (DE); Frank Werner, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/688,388

(22) Filed: Jan. 15, 2010

(65) Prior Publication Data

US 2010/0116918 A1 May 13, 2010

Related U.S. Application Data

(62) Division of application No. 10/471,622, filed as application No. PCT/EP02/02661 on Mar. 11, 2002, now Pat. No. 7,661,617.

(30) Foreign Application Priority Data

Mar. 13, 2001 (DE) ..... 101 11 907

(51) Int. Cl.
*B02C 4/32* (2006.01)
*B02C 7/14* (2006.01)
*B02C 9/04* (2006.01)

(52) U.S. Cl. ..... 241/36; 241/100; 241/236

(58) Field of Classification Search ..... 241/100, 241/236, 36

See application file for complete search history.

(56) References Cited

U.S. PATENT DOCUMENTS

| | | | | |
|---|---|---|---|---|
| 4,991,008 | A * | 2/1991 | Nama | 348/150 |
| 5,039,020 | A | 8/1991 | Leuthold et al. | |
| 5,188,301 | A | 2/1993 | Hasegawa | |
| 5,459,330 | A | 10/1995 | Venaille et al. | |
| 5,761,089 | A | 6/1998 | McInerny | |
| 6,351,552 | B1 | 2/2002 | Weaver et al. | |
| 6,661,910 | B2 | 12/2003 | Jones et al. | |
| 2009/0028415 | A1 | 1/2009 | Giering et al. | |

FOREIGN PATENT DOCUMENTS

| | | | |
|---|---|---|---|
| DE | 3843602 | A1 | 7/1990 |
| DE | 9401074.9 | U1 | 6/1995 |
| DE | 4413079 | A1 | 10/1995 |
| DE | 69206855 | T2 | 9/1996 |
| EP | 0374481 | A2 | 6/1990 |

(Continued)

*Primary Examiner* — Bena Miller

(74) *Attorney, Agent, or Firm* — Rothwell, Figg, Ernst & Manbeck, P.C.

(57) ABSTRACT

The invention relates to an apparatus for canceling, in particular destroying, sheet material, in particular bank notes. The apparatus includes at least one canceling means to which the sheet material to be canceled is fed, in which the fed sheet material is canceled, in particular destroyed, and from which the canceled sheet material is discharged. The apparatus also includes at least one supervising means for monitoring the sheet material being discharged or having been discharged from said canceling means. For improved monitoring of the cancellation of sheet material, in particular with respect to malfunctions, there is provided at least one monitoring means for monitoring the fed sheet material. The fed sheet material is compared to the sheet material being discharged or having been discharged in an evaluation means.

12 Claims, 4 Drawing Sheets

FOREIGN PATENT DOCUMENTS

| | | | |
|---|---|---|---|
| EP | 0505109 | A1 | 9/1992 |
| GB | 2209963 | A | 6/1989 |
| RU | 94026774 | A1 | 6/1996 |
| RU | 2144697 | C1 | 1/2000 |
| SU | 389399 | A1 | 7/1973 |
| WO | WO 9902976 | A1 | 1/1999 |

* cited by examiner

APPARATUS FOR CANCELING SHEET MATERIAL

This application is a division of and claims priority to application Ser. No. 10/471,622 filed Feb. 5, 2004, which is a national stage entry of application PCT/EP02/02661, filed Mar. 11, 2002, an international application claiming priority to DE 101 11 907.0 filed Mar. 13, 2001; the entire contents of each of these applications are hereby incorporated by reference into the present specification.

The invention relates to an apparatus for canceling (demonetizing), in particular destroying, sheet material, in particular bank notes, comprising at least one canceling means to which the sheet material to be canceled is fed, in which the fed sheet material is canceled, in particular destroyed, and from which the canceled sheet material is discharged, and at least one supervising means for monitoring the sheet material being discharged or having been discharged from the canceling means. In addition thereto, the invention relates to a method for canceling, in particular destroying, sheet material.

Apparatus and methods of the type concerned are employed in particular in bank note processing systems performing mechanical testing, sorting and optionally destruction of bank notes. In this context, bank notes are individually withdrawn from a stack, examined in accordance with various criteria for authenticity and/or condition, in particular soiling, limpness or damages, and depending on the result of this examination are assigned to specific sorting classes and finally fed to corresponding output means via a transport system. Damaged or severely soiled bank notes unfit for further circulation are fed to a corresponding means for destruction.

European patent specification EP 0 374 481 B1 discloses a bank note processing system in which the cut sheet material leaving a cutting means is detected immediately downstream of the cutting means by a sensor means, e.g. an optical sensor, an ultrasonic sensor or a sensor based on piezoelectric materials. For improving the reliability of monitoring, the sensor signals can be correlated with the signal of a light barrier arranged upstream of the cutting means.

The reliability of destruction of bank notes in such system, however, is subject to limits if there are transport disorders, e.g. jammed or overlapping bank notes, malfunctions in destruction of the bank notes or malfunctions in the energy supply, e.g. by power failure. In these events, it is possibly no longer reproducible without any doubt which ones or how many bank notes were actually passed to the cutting means and were properly destroyed there. In cases in which disorders, such as bank note jams, have to be overcome by manual labor of the operating personnel, an unauthorized withdrawal of bank notes that are located e.g. in the feed portion of the cutting means and still are undamaged or not destroyed properly, cannot be reliably proven at all times.

Especially in such cases in which a processing system is used for simultaneously processing and optionally destroying a plurality of different denominations, i.e. values of bank notes, not only secure counting, but also secure assignment of the destroyed bank notes to a denomination is necessary in order to ensure correct accounting of the values destroyed.

It is the object of the invention to indicate an apparatus and a method permitting improved monitoring of the canceling of sheet material, especially with respect to malfunctions.

This object is met by the apparatuses set forth in the independent claims. Advantageous developments are specified in the respective dependent claims thereof.

The invention is based on the idea of providing at least one monitoring means for monitoring the sheet material fed to the canceling means. The monitored, fed sheet material is compared to the sheet material being discharged or having been discharged in at least one evaluation means. This comparison involves in particular an examination whether the sheet material discharged from the canceling means and detected by the supervising means is identical with the expectations derived from monitoring the fed sheet material. For example, with respect to a fed sheet of large area, a greater amount of discharged, destroyed sheet material is to be expected than for a sheet of smaller area.

The monitoring means is preferably arranged in a feed portion upstream of the canceling means, in which the sheet material examined e.g. in a bank note processing system and intended to be canceled, is fed to the canceling means and is designed in particular for tracing the position of the sheets located in the feed portion and fed to the canceling means and/or for detecting specific properties of the fed sheets, i.e. print image, denomination, length, width or multiple withdrawals.

The supervising means for monitoring the sheet material being discharged or having been discharged is preferably arranged in an output portion subsequent to the canceling means, where the canceled sheet material leaves the canceling means.

By monitoring the fed sheet material, in particular by tracing the sheets to be canceled and/or by detecting the specific properties thereof, the fed sheets can be detected with higher accuracy than in case of utilization of a light barrier in the feed portion, as known from the prior art. The comparison of the thus monitored, fed sheet material with the sheet material being discharged, thus, permits more reliable and more accurate monitoring of the canceling operation. In particular, the invention permits easier and considerably more accurate reconstruction of malfunctions, such as e.g. jams or multiple withdrawals, in the feed portion.

The term canceling in the sense of the invention is to be understood as comprising any kind of canceling or demonetizing that is effected by applying a corresponding marking to the sheet material, e.g. by stamping the same, or by partial, e.g. by perforating, or complete destruction, e.g. shredding, of the sheet material.

The invention will be explained in more detail hereinafter by way of embodiments shown in the drawings, in which.

Figure 1:
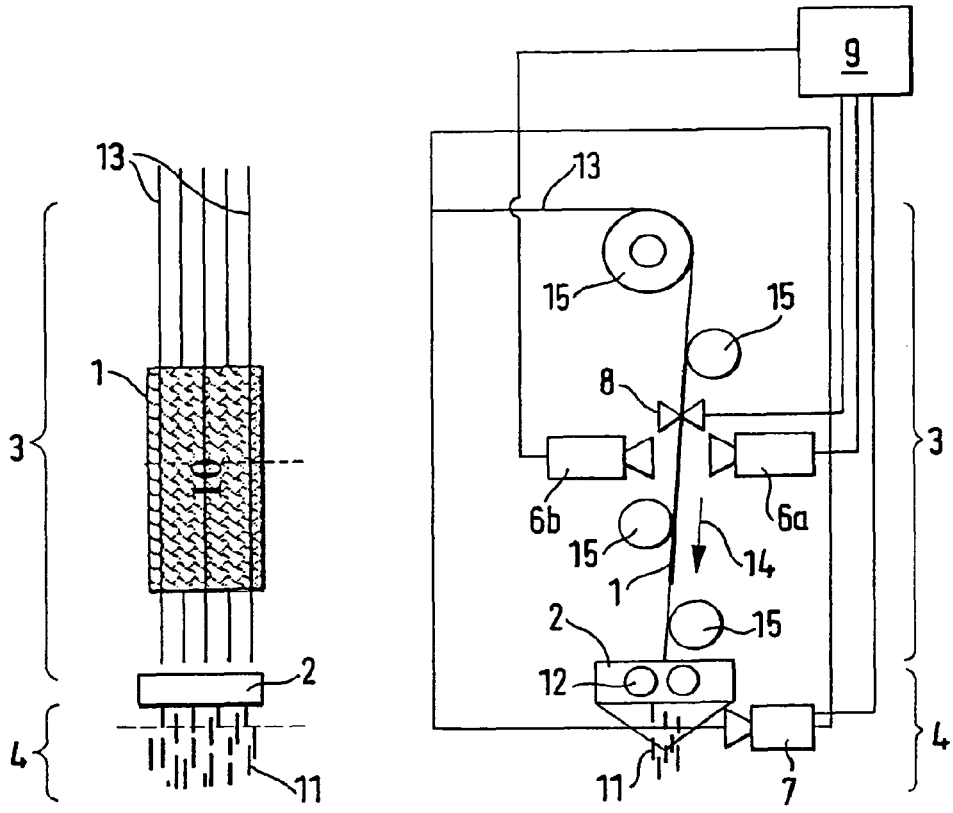
FIG. 1 shows an embodiment of the apparatus for monitoring the destruction of bank notes according to the invention.

FIG. 1 illustrates, in the right-hand portion of the view, an embodiment of the apparatus for monitoring the destruction of bank notes according to the invention. A bank note 1 to be destroyed is fed in a feed portion 3 by means of a transport system, consisting of transport belts 13 and transport rollers 15, in a transport direction 14 to a canceling means 2. In the embodiment illustrated, the demonetizing or canceling means 2 is a shredder in which the bank notes 1 to be destroyed are shredded upon passage thereof between rotating blade rollers 12. The sheet material 11 destroyed leaves the canceling means 2 in output portion 4 in the form of small shreds.

As monitoring means, there are provided image detecting means 6*a* and 6*b*, in particular cameras, in the feed portion 3, each taking pictures of the front and rear sides of bank notes 1 transported in feed portion 3 to the canceling means 2. The image detecting means 6*a* and 6*b* are preferably designed for continuous recording of images of the entire transport operation taking place in feed portion 3, inclusive of the bank notes 1 to be destroyed. In addition to the image detecting means 6*a* and 6*b*, the feed portion 3 has a first light barrier 8 arranged therein that generates information on the presence of bank notes 1 in the feed portion 3.

In the output portion 4, there is arranged a supervising means for monitoring the result of the destruction of the bank notes 1. The supervising means may be e.g. an acoustic, optical or piezoelectric sensor or a second image detecting means 7, in particular a camera, for taking pictures. The signals of the sensor or the images of the second image detecting means 7, respectively, are fed to an evaluation means 9 and are evaluated and/or stored there. In this regard, the sensor signals or images of the supervising means are preferably used for determining the mass flow or volume flow of the destroyed bank notes 11 discharged from canceling means 2. It is basically also possible to determine from the sensor signals and/or the images detected, the degree of destruction in percent and/or the average shred size of the shredded bank note 11 having been discharged or being discharged.

The information generated by first light barrier 8 is fed, together with the images of the processes in the feed and output portions 3 and 4, respectively, as detected by the image detecting means 6*a*, 6*b* and 7, to an evaluation means 9. In said evaluation means 9, data of the images detected can be stored together with the information detected by first light barrier 8. In case of need, especially in case of a malfunction in the feed portion 3 and/or in the output portion 4, the stored data and information may be compared to each other by correlating the progress in time of the stored information of the first light barrier 8 with the recorded progress in time of the detected images. This can be effected, for example, with the aid of a graphic representation of the data and information. On the basis of this correlation, it is then possible, either by intelligent software in the evaluation means 9 or by analysis by trained operating personnel, to determine or reconstruct the type and the progress of the malfunction at hand. In particular, it is possible to determine with high reliability which ones of the bank notes 1 to be destroyed have actually passed the canceling means 2 and have left the same as shreds 11 in output portion 4.

In the left-hand portion of FIG. 1, there is shown a side view of the path of a bank note 1 illustrated in the right-hand portion of FIG. 1. The bank note 1 is conveyed in feed portion 3 by means of a transport system, illustrated here in the form of transport belts 13 only, to the canceling means 2 and is destroyed there. In the output portion 4, the destroyed sheet material 11 leaves the canceling means 2 in the form of small, shredded pieces. The broken lines in the region of the bank note 1 and in output portion 4 each indicate the approximate position of the first and second image detecting means 6*a*, 6*b* and 7, respectively.

In the embodiment illustrated, the image detecting means 6*a*, 6*b* and 7 are in the form of line cameras. These take up a line-shaped section of the object passing the camera, in the instant case of the bank note 1 and the shreds 11, respectively, in sequential manner, i.e. in successive regular time intervals, which are then joined together so as to form a complete and continuous image sequence, i.e. a movie. The broken lines in the region of the bank note 1 and the shreds 11, respectively, indicate the approximate position of the line-shaped section.

Alternatively, the image detecting means 6*a*, 6*b* and 7 may be designed for detecting two-dimensional images with horizontal and vertical extension. In this case, the broken lines indicate the approximate image center of the image detected.

In a further alternative embodiment, the monitoring means comprises at least a first light barrier 8 in place of the image detecting means 6*a* and 6*b*. The items of information on the presence of bank notes 1 in feed portion 3, which are generated by the first light barrier 8, in case of this design are fed together with the images or signals, respectively, generated by the supervising means to the evaluation means 9, where they are stored and compared to each other, if necessary.

Figure 2:
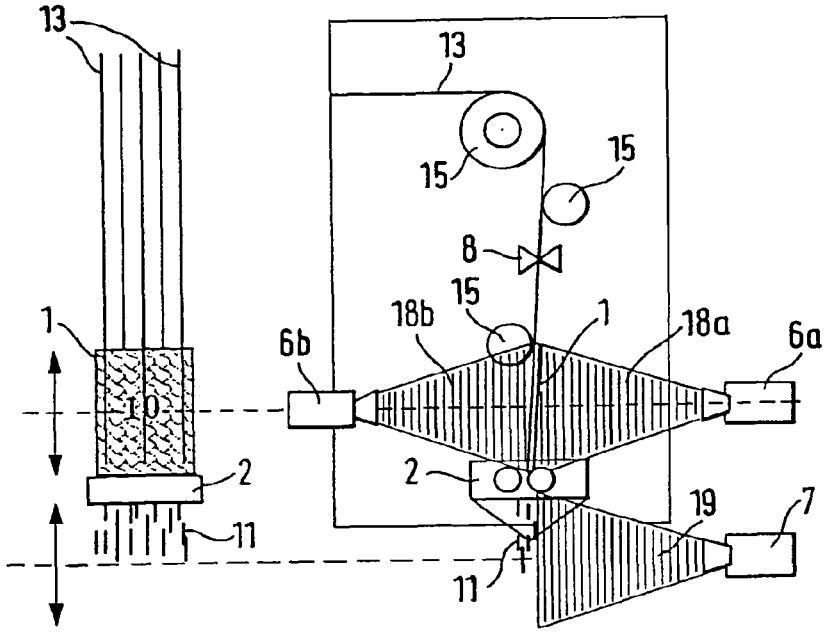
FIG. 2 shows a further embodiment of the apparatus according to the invention.

FIG. 2 shows, in the right-hand portion thereof, an embodiment of the invention in which the image detecting means 6*a*, 6*b* and 7, in particular cameras, are designed for detecting two-dimensional images. As compared to the example described with respect to FIG. 1, involving monitoring by line cameras and corresponding evaluation, this embodiment has the advantage that events in the entire particular recorded image section 18*a*, 18*b* and 19, respectively, are detected. Cameras particularly suited for this purpose have an image frequency of more than approx. 100 images per second. The image sections 18*a*, 18*b* and 19 recorded are preferably selected such that the region immediately in front of and/or subsequent to the canceling means 2 is detected as well. By way of the data recorded, the progress of the evaluation operation can be analyzed also in case of transport disorders in the immediate vicinity of canceling means 2, e.g. due to rolled up or delayed bank notes.

As already described with regard to the example illustrated in FIG. 1, the present embodiment also feeds the information generated by the first light barrier 8, together with the images detected by image detecting means 6*a*, 6*b* and 7, to an evaluation means (not shown), e.g. a computer system, where these are optionally stored.

The data of the image detecting means 6*a*, 6*b* and 7, respectively, in FIGS. 1 and 2 can be recorded permanently, adding thereto time information, e.g. clock signals or values of time derived therefrom. Recording is effected e.g. by video recording on tape or storing on a digital data carrier, e.g. a fixed disc of the computer system. For analysis of a malfunction, the data in immediate proximity in terms of time to said malfunction can be accessed with the aid of the stored information of time. As an alternative, it is possible to store the data first in a temporary memory of the computer system and to store only the data in immediate proximity in time to a malfunction in permanent manner on tape or a digital data carrier for subsequent analyses.

In addition to or as an alternative to the time information, the data of the image detecting means 6*a*, 6*b* and 7, respectively, may be recorded together with count information of a counter means. In a malfunction, it is then possible by way of the count information stored to access the data belonging to a specific count. The count information is produced e.g. by a counter means (not shown) counting the bank notes 1 fed to canceling means 2.

It is basically also possible to search the recorded data of the image detecting means 6*a*, 6*b* and 7 for the data and the image, respectively, of a bank note 1 looked for. The bank note looked for and/or additional bank notes in proximity in time of the bank note looked for can then be prosecuted on its path to the canceling means.

Analogously with the example illustrated by way of FIG. 1, FIG. 2 shows in the left-hand part thereof a side view of the path of a bank note 1 illustrated in the right-hand part in FIG. 1. The broken lines in the region of the fed and discharged bank notes 1 and 11, respectively, each indicate the central position of image sections 18*a* and 18*b* and 19 of the first and second image detecting means 6*a*, 6*b* and 7, respectively.

Figure 3:
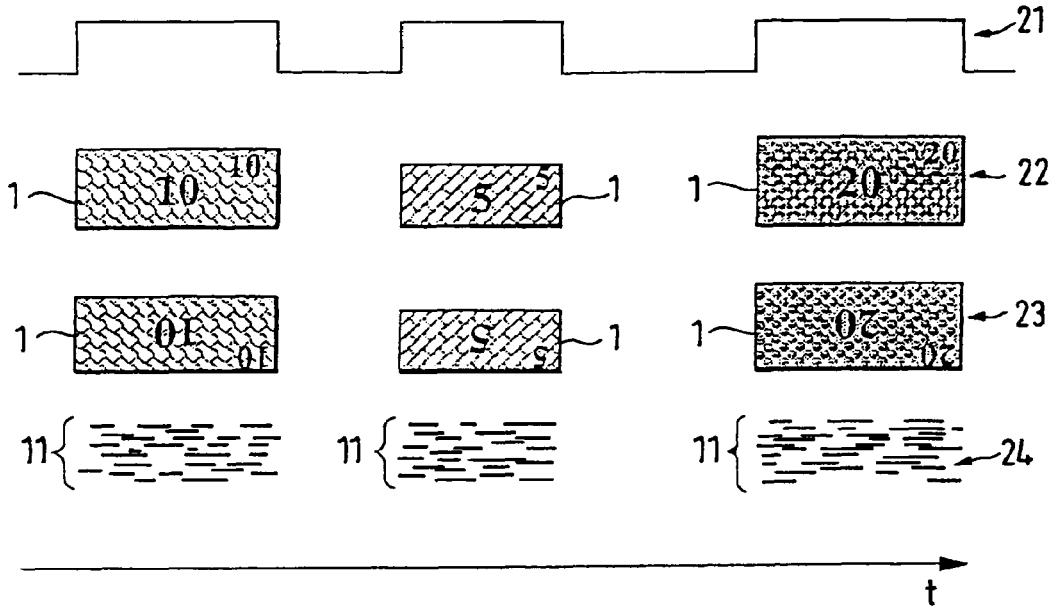
FIG. 3 shows a comparison of the fed bank notes with the bank notes discharged from the canceling means in case of bank note transport without malfunction.

FIG. 3 illustrates a comparison of the fed bank notes 1 with the bank notes 11 discharged from the canceling means in case of bank note transport without malfunction. In this example, the images 22, 23 and 24 of the bank notes 1 to be destroyed and of the destroyed bank notes 11, respectively, which are detected by the image detecting means 6*a*, 6*b* and 7, are illustrated together with the course of signal 21 of the first light barrier 8 with respect to time t. In this schematic representation, the actual differences in transit time between the positions of the bank notes 1 in the region of the first light barrier 8, the first image detecting means 6*a* and 6*b* and the second image detecting means 7 have been eliminated so that events belonging to a particular bank note 1 are each located directly below each other. With this representation, the comparison of the data and thus the analysis or reconstruction of malfunctions in the entire canceling procedure can be carried out in especially simple, secure and clear manner.

By comparison of the light barrier signal 21 to the images 22 and 23 of the bank notes 1 to be destroyed, which are recorded by both cameras 6*a* and 6*b*, respectively, and to the images 24 of the destroyed bank notes 11 taken up by camera 7, it is easily recognizable that the canceling operation has taken place properly for all bank notes 1 to be destroyed, indicating the values 10, 5 and 20, respectively. This can be seen, on the one hand, due to the fact that the images detected by cameras 6*a* and 6*b* each show the front side and the rear side, respectively, of only one bank note with the value 10, 5 and 20, respectively. On the other hand, the length in time of the light barrier signals 21 generated in case of the respective bank notes 1 is obviously correlated with the spatial length of the individual bank notes 1 detected in images 22 and 23. The images 24 of the destroyed bank notes 11, taken up by camera 7, also are in conformity with the respective amount of shreds to be expected from the canceling means, since bank notes 1 of large area, such as e.g. the bank note having the value 20, lead to a larger quantity of shreds in output portion 4 of the canceling means 2 than bank notes 1 of small area, such as e.g. the bank note having the value 5.

Figure 4:
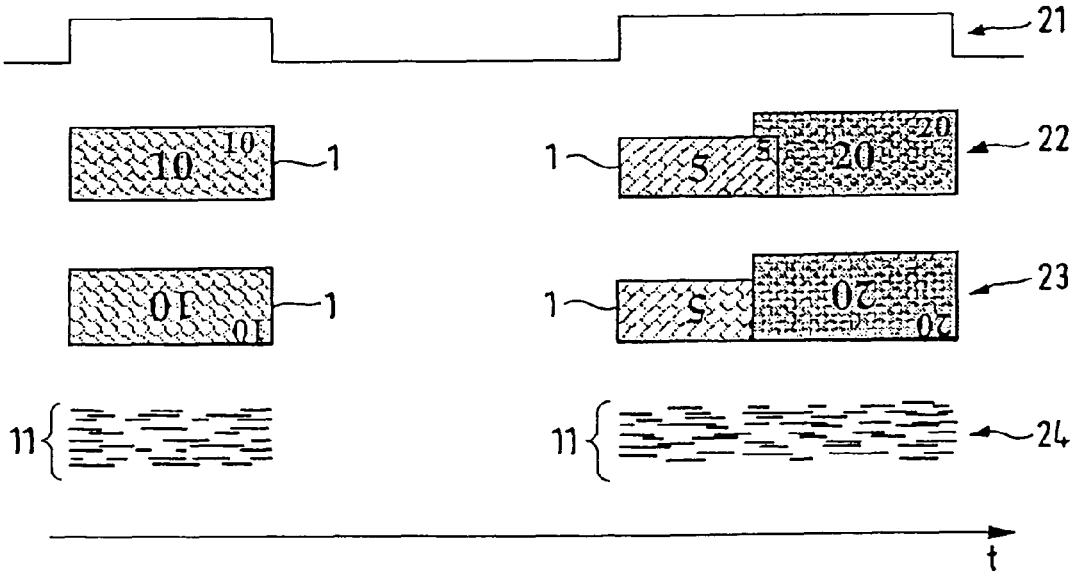
FIG. 4 shows a comparison of the fed bank notes with the bank notes discharged from the canceling means in case of bank note transport subject to malfunction.

FIG. 4 illustrates the comparison of the fed bank notes 1 with the bank notes 11 discharged from the canceling means in case of bank note transport that is subject to malfunction. In the example chosen, the bank note with the value 5 was briefly delayed and transported further only together with the bank note with the value 20. Thus, it passes the first light barrier 8 as well as the cameras 6*a* and 6*b* in feed portion 3 together with said latter bank note. Upon passage of the first light barrier 8, there is thus a correspondingly longer light barrier signal 21 detected. On the basis of the images 23 and 22 taken up by the image detecting means 6*a* and 6*b*, it is then easily recognizable in case of a malfunction that this relatively long light barrier signal 21 is due to two partially overlapping bank notes. At the same time, it is possible to recognize the denomination, i.e. the value of the bank notes participating in the malfunction.

For examining proper destruction of both bank notes, the images 24 detected by image detecting means 7 in the output portion 4 of the canceling means 2 are utilized. As can be seen in the schematic representation, the amount of shreds 11 detected in the corresponding time period by way of the images 24 recorded is in conformity with the length of the two partially overlapping bank notes so that proper destruction of both bank notes 1 may be presumed. The bank note with the value 10 processed subsequently, finally, shows again the canceling course to be expected for single bank notes, which was already explained in more detail with reference to FIG. 3. The sole judgment of the light barrier signal 21 would not permit an unequivocal reconstruction of the events, especially if the bank note 1 with the value 5 had been delayed such that it would have been covered completely by the bank note 1 with the value 20. Without the corresponding image data, it would not be recognizable then to find out whether bank note 1 with the value 5 was stopped or withdrawn prior to the first light barrier 8 or whether it was destroyed together with bank note 1 with the value 20.

Figure 5:
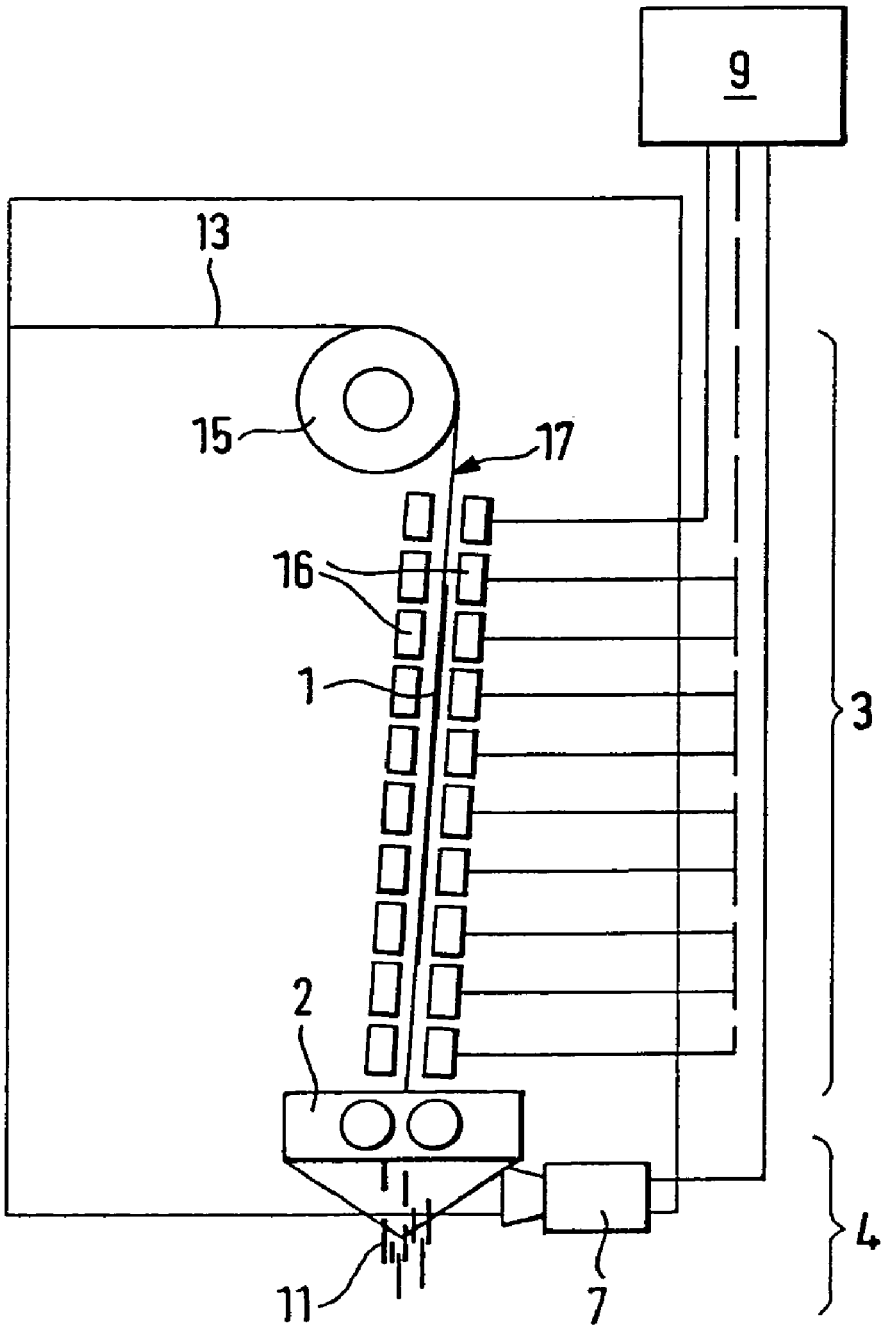
FIG. 5 shows an additional embodiment of the invention comprising a monitoring means consisting of several sensor means.

FIG. 5 illustrates an additional embodiment of the invention. The feeding of bank notes 1 to the canceling means 2 along a transport path 17 takes place, as in the embodiment of FIG. 1, by means of a transport system consisting of transport belts 13 and transport rollers 15. In the feed portion 3, there are arranged several sensor means 16 along transport path 17, detecting the position of a bank note 1 to be destroyed on transport path 17. For better visibility, only one of the nine sensor pairs bears a reference numeral 16. In particular, the sensor means 16 are designed for tracing the position of the bank notes 1 conveyed along transport path 17. The sensor means 16 may be arranged as close as possible in succession in order to obtain high local resolution and for allowing the current position of a bank note 1 on transport path 17 to be located as exactly as possible at all times.

As sensor means 16 for tracing the bank notes 1, there are employed e.g. transmission sensors allowing detection of the translucency of the bank notes 1. From the translucency measured, it is possible e.g. to determine which kind or which value of bank note is present or, possibly, whether a multiple withdrawal is present. As an alternative, it is also possible to use simple light barriers as sensor means 16 for detecting the position of the leading and trailing edges of the bank notes 1.

In addition thereto, at least one of the sensor means 16 may be designed for detecting at least one specific property, e.g. denomination, print image, dimensions or multiple withdrawals, of the sheet material 1. This has the advantage that, in addition to the position of the fed bank notes 1, it is possible to monitor how many and in particular what bank notes 1 are fed. For example, a sensor means 16 may be provided in the form of a simple print image detector that merely examines whether or not the sheets transported to canceling means 2 have a print image. Unauthorized channeling in of unprinted blanks can thus be easily recognized.

In the output portion 4 of canceling means 2, there is provided a supervising means 7, in particular a camera, detecting the destroyed bank notes 11 discharged from the canceling means 2. The supervising means 7 and the outputs of the sensor means 16 are connected to evaluation unit 9. For reasons of better illustration, only the connections of the two outer sensor means 16 to the evaluation unit 9 are illustrated completely. For reasons of simplification, the connections of the outputs of all other sensor means 16 to the evaluation means 9 are indicated by a broken line.

In the evaluation means 9, there is performed a comparison of the feeding of bank notes 1 monitored by the sensor means 16 and of the bank notes 11 monitored by the supervising means 7. The correlation of the signals of the sensor means 16 with the images of the supervising means 7 is effected analogously with the examples described with reference to FIGS. 3 and 4.

Special image recognition methods in evaluation means 9 render possible additional monitoring functions on the basis of the signals of image detecting means 7. It is generally presumed that a destroyed bank note 1 cannot be reconstructed any more from the shreds 11 if the shreds 11 do not exceed a certain maximum size in accordance with the constructional design measures of canceling means 2. However, a mechanical defect of canceling means 2, e.g. by breakage or wear of cutting elements, may cause a general or locally restricted increase in shred size. By way of calculating the average and maximum sizes of shreds 11 in evaluation means 9, a malfunction of canceling means 2 can be detected immediately upon occurrence thereof, and bank note processing can be stopped along with a-corresponding error report.

Another possibility of evaluation consists in comparing the area of the original bank note 1 with the number and the dimensions of the shreds 11, thus examining whether the bank note 1 has been fully destroyed. This calculation takes place in approximated manner by determining the overall area of shreds 11 that is in proportional relation to the area of bank note 1. In consideration of the known thickness of bank note 1, a volume flow of the shreds 11 can be determined on this basis as well.

In a development of the invention, the supervising means 7 at the output of canceling means 2 is adapted to detect the mass flow of the shreds 11. This measurement can be carried out e.g. on the basis of a measurement device in accordance with the Coriolis principle. By comparison of the expected values due to the mass of bank notes 1 fed and the mass flow of shreds 11 measured, it is possible to check whether the bank notes 1 have been destroyed fully and at the expected moment of time.

Figure 6:
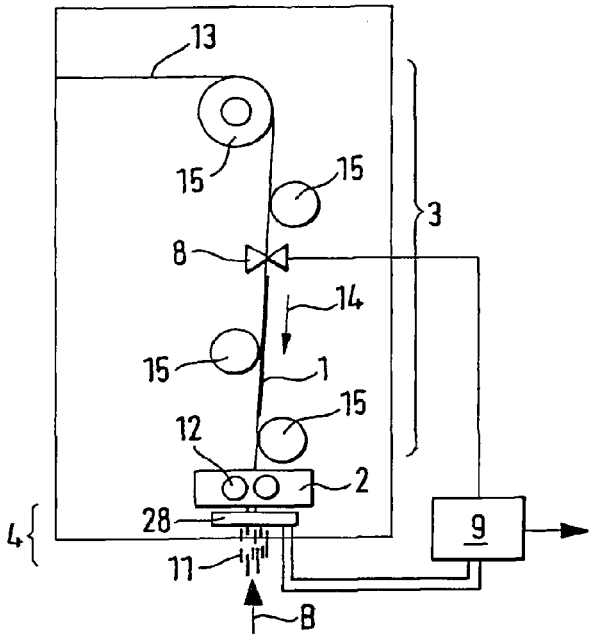
FIG. 6 shows a development of the invention comprising a supervising means including a light curtain.

FIG. 6 shows an additional development of the invention. As monitoring means monitoring the feeding of bank note 1 to be destroyed to canceling means 2, there is provided a first light barrier 8 for detecting the presence of a bank note 1 to be destroyed in the feed portion 3. The transport of bank note 1 as well as cancellation thereof in canceling means 2 are effected in accordance with the embodiment described in conjunction with FIG. 1.

The canceled bank note 11 discharged from canceling means 2 is monitored by a supervising means comprising a second light barrier 28 arranged in output portion 4 of canceling means 2. The light of the second light barrier 28 forms a light curtain consisting in essence of light beams extending in one or several planes. The bank note 11 discharged from canceling means 2 passes through the light curtain of the second light barrier 28, and depending on the result of the cancellation or destruction, there are generated different light barrier signals. The latter are fed—preferably together with the light barrier signals of first light barrier 1—to evaluation means 9 for storage and/or evaluation.

Figure 7A:
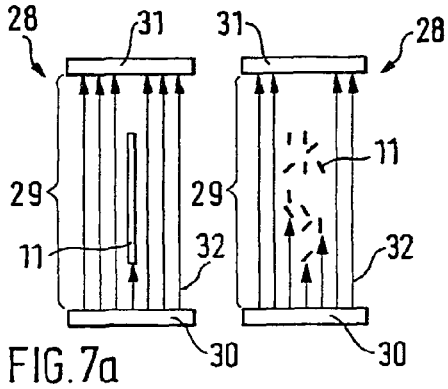
FIG. 7 shows a) a schematic construction of the second light barrier illustrated in FIG. 6, and b) a corresponding signal path.

FIG. 7*a* illustrates the basic structure and the mode of operation of the second light barrier 28 shown in FIG. 6, in a schematic representation as seen in viewing direction B, both when the bank note 11 is not destroyed and when the same is destroyed (left- and right-hand parts of illustration). The light barrier 28 has a line-shaped light source 30, for example a series of light emitting diodes emitting light as homogeneously as possible. In an alternative embodiment, the light source 30 generates a laser beam that is fanned out by an optical means having e.g. a cylindrical scattering lens. The rays of the light 32 emitted by light source 30 constitute at least one plane 29, i.e. a light curtain, and are detected by a line-shaped light receiver 31. The light receiver 31 is preferably designed for integral, i.e. not location-resolved, detection of the light impinging thereon. The light source 30 and the light receiver 31 preferably have one end each attached to a common rod-shaped support (not shown), thus forming a U-shaped profile. Such light barrier arrangements are therefore also referred to as fork-type light barriers. In a further embodiment, the light source 30 and/or light barrier 31 may also be attached directly to canceling means 2, independently of each other. The light 32 may have spectral components in the visible and/or non-visible spectral range and may be of monochrome or broadband nature.

The line-shaped light source 30 and the line-shaped light receiver 31 in this embodiment are each arranged such that the light beams 32 are substantially parallel to the plane of a bank note 11 being discharged. In the embodiment illustrated, this is achieved in that the light source 30 and the light receiver 31 are oriented perpendicularly to the plane of the bank note 11 being discharged.

In the example of the left-hand part of FIG. 7*a*, a non-destroyed bank note 11 passes through light barrier 29, with only a small portion of the light beams 32 being reflected or weakened by bank note 11. In contrast thereto, in the example of the right-hand part of FIG. 7*a*, the shred cloud of a destroyed bank note 11 moves through light curtain 29 so that more light beams 32 are reflected or weakened. The amount of light detected by light receiver 31 is correspondingly lower as compared to the example in the left-hand part of the illustration.

Figure 7B:
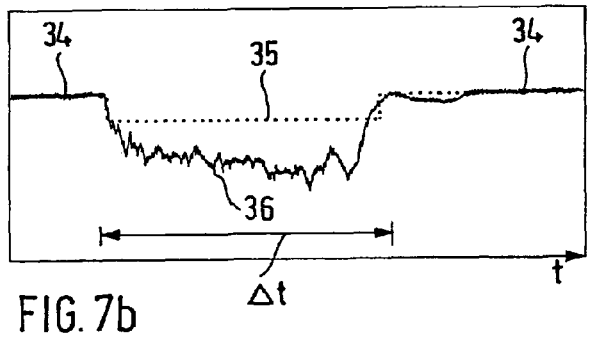

This is reflected in the time-related course or pattern of the respective light barrier signals in FIG. 7*b*: The signal 35 of light barrier 28 obtained when bank note 11 is not destroyed displays, in time interval $\Delta t$ in which bank note 11 passes through light barrier 28, a clearly smaller signal reduction in relation to the output signal 34 without bank note as compared to the signal 36 obtained due to the shred cloud in case of destroyed bank note 11. It is thus possible to draw conclusions from the respective light barrier signal 34 to 36 obtained from light barrier 28 as to the result of the cancellation operation.

For evaluation, there are preferably limit values preset for the signal reduction of the light barrier signal 28. A simple comparison of the signal reduction measured to the limit value will then reveal whether the bank note 11 has been destroyed properly or only partially, i.e. has not been destroyed. In the latter case, provisions may be made, for example, for immediate stopping of the processing operation.

Figure 8A:
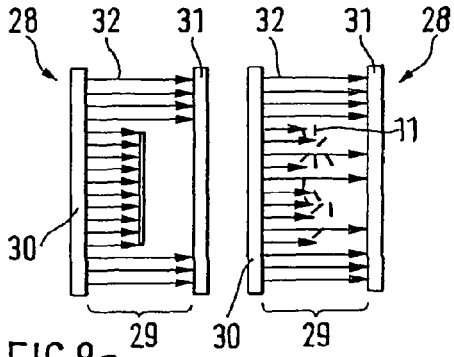
FIG. 8 shows a) a schematic construction of an alternative development of the second light barrier, and b) a corresponding signal path.

FIG. 8*a* illustrates a modification of the embodiment shown in FIG. 7*a*. In this example, the line-shaped light source 30 and the line-shaped light receiver 31 are each arranged such that the light beams 32 extend substantially perpendicularly to the plane of a bank note 11 being discharged. In this example, this is achieved in that the line-shaped light source 30 and the line-shaped light receiver 31 are oriented substantially parallel to the plane of the bank note 11 being discharged.

In the example of the left-hand part of FIG. 8*a*, a non-destroyed bank note 11 passes light curtain 29. In doing so, a large portion of the light beams 32 is reflected or at least significantly weakened by bank note 11. In the example of the right-hand part of FIG. 8, the shred cloud of a destroyed bank note 11 passes light curtain 29, with the light beams 32 being reflected or weakened less in comparison with the non-destroyed bank note 11 (left-hand part of illustration). Consequently, the amount of light detected by light receiver 31 is greater than in case of the left-hand part of the illustration.

Figure 8B:
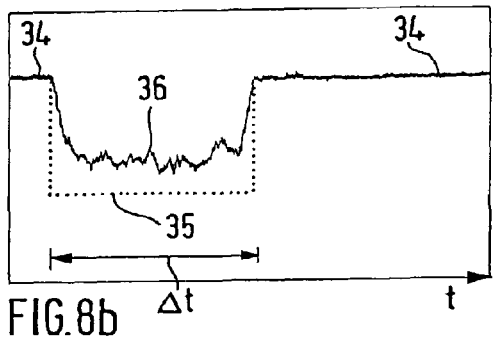

This relationship is recognizable from the time-related course or pattern of the respective light barrier signals in FIG. 8*b*: The signal 35 of light barrier 28 obtained when bank note 11 is not destroyed displays, in time interval Δt in which bank note 11 passes through light barrier 28, a greater signal reduction in relation to the output signal 34 without bank note as compared to the signal 36 obtained due to the shred cloud when bank note 11 is destroyed. It is thus possible in this case as well to draw conclusions from the respective light barrier signal 35 or 36 obtained from light barrier 28 as to the result of the cancellation operation.

The evaluation of signals 34 to 36 of light barrier 28 in evaluation means 9 by comparison with signals and/or images of the monitoring means, i.e. the light barrier 8 and/or the image detecting means 6*a* and 6*b*, takes place analogously with the examples described with reference to FIGS. 3 and 4.

Seen in total, the use of the light barrier 28 with light curtain provides for especially simple and reliable monitoring of the sheet material 11 being discharged from canceling means 2.

In addition thereto, the light barrier 28 with light curtain, as described herein-before, is also suitable as monitoring means in feed portion 3 in order to provide for simple and reliable monitoring of the fed sheet material 1 at that location as well.

We claim:

1. An apparatus for canceling, in particular destroying, sheet material, in particular bank notes, comprising:

at least one canceling means to which the sheet material to be canceled is fed, in which the fed sheet material is canceled, in particular destroyed, and from which the canceled sheet material is discharged;

at least one supervising means for monitoring the sheet material being discharged or having been discharged from said canceling means;

at least one monitoring means for monitoring the fed sheet material; and at least one evaluation means for comparing the fed sheet material to the sheet material being discharged or having been discharged;

wherein at least one of the supervising means and the monitoring means includes a light barrier configured to monitor the fed sheet material and the discharged sheet material, respectively, by means of light establishing a light curtain.

2. The apparatus according to claim 1, wherein at least one of said light barriers comprises a line-shaped light transmitter for emitting light beams extending in at least one plane.

3. The apparatus according to claim 1, wherein the evaluation means utilizes signals from the supervising means and the monitoring means for comparing the fed sheet material to the sheet material being discharged or having been discharged.

4. The apparatus according to claim 2, wherein at least one said light barrier comprises a line-shaped light receiver for detecting light beams extending in at least one plane.

5. The apparatus according to claim 4, wherein the line-shaped light receiver is designed for integral detection of light.

6. The apparatus according to claim 4, wherein the line-shaped light transmitter and the line-shaped light receiver are arranged such that light beams extend substantially parallel to the plane of the sheet material discharged from the canceling means.

7. The apparatus according to claim 6, wherein the line-shaped light transmitter and the line-shaped light receiver are oriented substantially perpendicularly to the plane of the discharged sheet material.

8. The apparatus according to claim 4, wherein the line-shaped light transmitter and the line-shaped light receiver are arranged such that the light beams are substantially perpendicular to the plane of the sheet material discharged from the canceling means.

9. The apparatus according to claim 8, wherein the line-shaped light transmitter and the line-shaped light receiver are oriented substantially parallel to the plane of the sheet material discharged.

10. An apparatus for canceling, in particular destroying, sheet material, in particular bank notes, comprising:

at least one canceling means to which the sheet material to be canceled is fed, in which the fed sheet material is canceled, in particular destroyed, and from which the canceled sheet material is discharged;

at least one supervising means for monitoring the sheet material being discharged or having been discharged from said canceling means;

at least one monitoring means for monitoring the fed sheet material; and at least one evaluation means for comparing the fed sheet material to the sheet material being discharged or having been discharged, said evaluation means configured to store information detected by at least one of the supervising means and the monitoring means, wherein at least one of the supervising means and the monitoring means includes a light barrier configured to monitor the fed sheet material and the discharged sheet material, respectively, by means of light establishing a light curtain.

11. An apparatus for canceling, in particular destroying, sheet material, in particular bank notes, comprising:

at least one canceling means to which the sheet material to be canceled is fed, in which the fed sheet material is canceled, in particular destroyed, and from which the canceled sheet material is discharged;

at least one supervising means for monitoring the sheet material being discharged or having been discharged from said canceling means;

at least one monitoring means for monitoring the fed sheet material; and at least one evaluation means for comparing the fed sheet material to the sheet material being discharged or having been discharged, wherein the evaluation means is configured to time correlate signals between two or more of the at least one supervising means and at least one monitoring means, wherein at least one of the supervising means and the monitoring means includes a light barrier configured to monitor the fed sheet material and the discharged sheet material, respectively, by means of light establishing a light curtain.

12. An apparatus for canceling, in particular destroying, sheet material, in particular bank notes, comprising:

at least one canceling means to which the sheet material to be canceled is fed, in which the fed sheet material is canceled, in particular destroyed, and from which the canceled sheet material is discharged;

at least one supervising means for monitoring the sheet material being discharged or having been discharged from said canceling means;

at least one monitoring means for monitoring the fed sheet material; and at least one evaluation means for comparing the fed sheet material to the sheet material being discharged or having been discharged, wherein the evaluation means is configured to employ a graphic representation of signals from one or more of the at least one supervising means and at least one monitoring means, wherein at least one of the supervising means and the monitoring means includes a light barrier configured to monitor the fed sheet material and the discharged sheet material, respectively, by means of light establishing a light curtain.

* * * * *